US007523702B2

(12) United States Patent
Oshima et al.

(10) Patent No.: US 7,523,702 B2
(45) Date of Patent: Apr. 28, 2009

(54) METHOD AND SYSTEM FOR CONTROLLING THERMAL HEAD AND STENCIL MATERIAL ROLL

(75) Inventors: Kenji Oshima, Ami-machi (JP); Takashi Isozaki, Ami-machi (JP); Morio Ohashi, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 464 days.

(21) Appl. No.: 10/541,718

(22) PCT Filed: Dec. 4, 2003

(86) PCT No.: PCT/JP03/15551

§ 371 (c)(1),
(2), (4) Date: Sep. 28, 2005

(87) PCT Pub. No.: WO2004/062914

PCT Pub. Date: Jul. 29, 2004

(65) Prior Publication Data

US 2006/0107851 A1 May 25, 2006

(30) Foreign Application Priority Data

Jan. 10, 2003 (JP) ..... 2003-004310

(51) Int. Cl.
*B41C 1/14* (2006.01)

(52) U.S. Cl. ..... 101/128.4; 400/120.11; 400/120.12

(58) Field of Classification Search ..... 400/120.01, 400/120.09, 120.11, 120.12, 249; 101/114, 101/128.4, 129, 484
See application file for complete search history.

(56) References Cited

U.S. PATENT DOCUMENTS

| | | | |
|---|---|---|---|
| 6,530,519 | B1 | 3/2003 | Suzuki |
| 6,632,515 | B1 | 10/2003 | Matsuura |
| 6,747,682 | B2 | 6/2004 | Kidoura et al. |
| 6,786,146 | B2 | 9/2004 | Kidoura et al. |

FOREIGN PATENT DOCUMENTS

| | | | |
|---|---|---|---|
| JP | 10329401 | A * | 12/1998 |
| JP | 2001-260406 | | 9/2001 |
| JP | 2001260406 | | 9/2001 |
| JP | 2001287333 | | 10/2001 |
| JP | 2001-315461 | | 11/2001 |
| JP | 2001315461 | | 11/2001 |
| JP | 200207946 | | 3/2002 |
| JP | 2002144689 | | 5/2002 |

* cited by examiner

*Primary Examiner*—Ren Yan
(74) *Attorney, Agent, or Firm*—Thomas F. Presson; Matthew K. Ryan; Frommer Lawrence and Haug

(57) ABSTRACT

In a thermal head control system for controlling heating energy to a thermal had perforating stencil material unrolled from a stencil material roll, the heating energy to a thermal head is controlled according to the surface condition of the stencil material. The residue of stencil material M in a stencil material roll is calculated by residue calculating means and the elapsed time of the stencil material roll from production thereof is obtained on the basis of date data on the date of production of the stencil roll. Further, kind data on the kind of stencil material stored in the storage portion is obtained and the heating energy is obtained on the basis of the residue, the elapsed time and the kind data. On the basis of this heating energy, the heating action of the thermal head is controlled.

6 Claims, 4 Drawing Sheets

FIG.3A

| RESIDUE (NUMBER) | ELAPSED TIME | | | |
|---|---|---|---|---|
| | 0~3 MONTHS | 4~6 MONTHS | 7~12 MONTHS | 13~18 MONTHS |
| 200~31 | STANDARD | STANDARD | STANDARD | STANDARD |
| 30~21 | STANDARD | STANDARD | STANDARD | +2.5% |
| 20~11 | STANDARD | STANDARD | +2.5% | +5.0% |
| 10~0 | STANDARD | STANDARD | +2.5% | +5.0% |

FIG.3B

| RESIDUE (NUMBER) | ELAPSED TIME | | | |
|---|---|---|---|---|
| | 0~3 MONTHS | 4~6 MONTHS | 7~12 MONTHS | 13~18 MONTHS |
| 200~31 | STANDARD | STANDARD | STANDARD | STANDARD |
| 30~21 | STANDARD | +2.5% | +2.5% | +2.5% |
| 20~11 | STANDARD | +2.5% | +5.0% | +7.5% |
| 10~0 | STANDARD | +5.0% | +7.5% | +10% |

METHOD AND SYSTEM FOR CONTROLLING THERMAL HEAD AND STENCIL MATERIAL ROLL

FIELD OF THE INVENTION

This invention relates to a thermal head control system which controls heating energy to a thermal head which perforates stencil material unrolled from a stencil material roll.

BACKGROUND OF THE INVENTION

There have been variously proposed stencil printers where print is made by driving, for instance, a thermal head according to image data obtained by reading out an original by, for instance, a scanner to selectively melt and perforate stencil material to make a stencil, winding the stencil around a printing drum, supplying ink inside the printing drum, and transferring the ink to printing papers through the stencil by, for instance, a roller.

In the stencil printers described above, a stencil material roll into which the stencil material is rolled is employed to improve the operability. However, the surface smoothness of the stencil material roll to be brought into close contact with the thermal head deteriorates as compared with the surface smoothness of the stencil material in the form of a sheet before it is rolled for, for instance, the rolling pressure when the stencil material is rolled into a roll. The deterioration of the surface smoothness increases toward the core of the stencil material roll and increases as the elapsed time from the production thereof increases. When the surface smoothness of the stencil material deteriorates, the thermal head is variously brought into contact with the stencil material and sites easy to perforate and sites difficult to perforate are generated in the stencil material, whereby the quality of the printed images deteriorates. In order to overcome this problem, there has been proposed, in Japanese Unexamined Patent Publication No. 2002-79646, a method where fluctuation in perforation is avoided by visually or optically detecting the surface condition of the stencil material and controlling the heating energy to the thermal head according to the detected surface condition of the stencil material.

However, the method disclosed in Japanese Unexamined Patent Publication No. 2002-79646 is disadvantageous in that visual detection of the surface condition of the stencil material is limited and setting of the suitable heating energy to the thermal head is sometimes impossible, and optical detection of the surface condition of the stencil material adds to the overall size of the system and to the cost of the system.

In view of the foregoing observation and description, the primary object of the present invention is to provide a thermal head control system which can control the heating energy to a thermal head according to the surface condition of the stencil material without adding to the overall size of the system or to the cost of the system.

SUMMARY OF THE INVENTION

In accordance with the present invention, there is provided a first thermal head control method of controlling heating energy to a thermal head which perforates stencil material unrolled from a stencil material roll and is characterized by the steps of obtaining a residue of the stencil material in the stencil material roll, and controlling the heating energy to the thermal head on the basis of the residue of the stencil material obtained.

In the first thermal head control method, the kind of the stencil material may be obtained and the heating energy to the thermal head may be controlled on the basis of the kind of the stencil material obtained and the residue.

Further, the elapsed time from the production of the stencil material roll may be obtained and the heating energy to the thermal head may be controlled on the basis of the elapsed time from the production of the stencil material roll obtained and the residue.

In accordance with the present invention, there is provided a second thermal head control method of controlling heating energy to a thermal head which perforates stencil material unrolled from a stencil material roll and is characterized by the steps of obtaining the elapsed time from the production of the stencil material roll, and controlling the heating energy to the thermal head on the basis of the elapsed time.

In the second thermal head control method, the kind of the stencil material may be obtained and the heating energy to the thermal head maybe controlled on the basis of the kind of the stencil material obtained and the elapsed time.

In accordance with the present invention, there is provided a first thermal head control system for controlling heating energy to a thermal head which perforates stencil material unrolled from a stencil material roll and is characterized by a residue obtaining means which obtains a residue of the stencil material in the stencil material roll, and a thermal head controlling means which controls the heating energy to the thermal head on the basis of the residue obtained by the residue obtaining means.

The first thermal head control system may further comprise a temperature detecting means which detects the working environmental temperature of the thermal head and the thermal head controlling means may control the heating energy to the thermal head on the basis of the working environmental temperature of the thermal head detected by the temperature detecting means and the residue.

The first thermal head control system may further comprise a kind obtaining means which obtains the kind of the stencil material and the thermal head controlling means may control the heating energy to the thermal head on the basis of the kind of the stencil material obtained by the kind obtaining means and the residue.

The first thermal head control system may further comprise an elapsed time obtaining means which obtains the elapsed time from the production of the stencil material roll and the thermal head controlling means may control the heating energy to the thermal head on the basis of the elapsed time from the production of the stencil material roll obtained by the elapsed time obtaining means and the residue.

Further, the stencil material roll may be provided with a storage means which stores residue data according to the residue of the stencil material and the residue obtaining means may obtain the residue of the stencil material on the basis of the residue data read out from the storage means.

In accordance with the present invention, there is provided a second thermal head control system for controlling heating energy to a thermal head which perforates stencil material unrolled from a stencil material roll and is characterized by an elapsed time obtaining means which obtains the elapsed time from the production of the stencil material roll, and a thermal head controlling means which controls the heating energy to the thermal head on the basis of the elapsed time obtained by the elapsed time obtaining means.

The second thermal head control system may further comprise a temperature detecting means which detects the working environmental temperature of the thermal head and the thermal head controlling means may control the heating energy to the thermal head on the basis of the working environmental temperature of the thermal head detected by the temperature detecting means and the elapsed time.

The second thermal head control system may further comprise a kind obtaining means which obtains the kind of the stencil material and the thermal head controlling means may control the heating energy to the thermal head on the basis of the kind of the stencil material obtained by the kind obtaining means and the elapsed time.

Further, in the first and second thermal head control systems, the stencil material roll may be provided with a storage means which stores date data on the date of production of the stencil material roll and the elapsed time obtaining means may obtain the elapsed time on the basis of the date data on the date of production of the stencil material roll read out from the storage means.

Further, in the first and second thermal head control systems, the stencil material roll may be provided with a storage means which stores kind data according to the kind of the stencil material and the kind obtaining means may be a means for reading out the kind data from the storage means.

In accordance with the present invention, there is provided a first stencil material roll which is used for carrying out the first thermal head control method described above and comprises a storage means which stores residue data according to the residue of the stencil material.

In accordance with the present invention, there is provided a second stencil material roll which is used for carrying out the first and second thermal head control methods described above and comprises a storage means which stores kind data according to the kind of the stencil material.

In accordance with the present invention, there is provided a third stencil material roll which is used for carrying out the first and second thermal head control methods described above and comprises a storage means which stores date data on the date of production of the stencil material roll.

The expression "to control the heating energy to the thermal head" as used here means, for instance, "to control the voltage applied to the thermal head", or "to control the energizing time".

Further, in order "to obtain a residue", the residue may be obtained either by the operator of the system directly inputting the residue through a predetermined input means, by measuring the diameter of the stencil material roll and calculating the residue on the basis of the measured diameter of the stencil material roll, or by obtaining in advance the total length of the stencil material in the stencil material roll before use and cumulatively subtracting the consumption of the stencil material to obtain the residue. Further, the residue need not be directly obtained but consumption of the stencil material may be obtained as a value which indirectly represents the residue. Further, residue data or data on the above-mentioned total length or consumption may be stored in a memory provided in the stencil material roll, and the residue maybe obtained by reading out the same. Further, the expression "a residue of the stencil material in the stencil material roll" means the overall length of the stencil material when the stencil material roll is before use.

Further, the expression "to control the heating energy to the thermal head according to the residue" means to control the heating energy to increase as the residue decreases, since the surface smoothness of the stencil material deteriorates as the residue of the stencil material decreases as described above.

Further, the expression "to control the heating energy to the thermal head according to the working environmental temperature and the residue" means to control, for instance, the heating energy to increase as the working environmental temperature lowers when the residue is the same, since the surface temperature of the thermal head sometimes differs according to the working environmental temperature even if the same heating energy is applied to the thermal head.

Further, the "kind of the stencil material" may be any so long as it includes information which is peculiar to the stencil material and affects contact of the thermal head to the stencil material. For example, when the stencil material comprises thermoplastic film and porous support film laminated each other, the "kind of the stencil material" may be information representing the kind of the thermoplastic film or the porous support film or the modulus of the thermoplastic film, the porous support film or the stencil material. Further, the above-mentioned "kind of the stencil material" may be any so long as it represents information representing the kind of the stencil material. For example, it may be either in information itself representing the kind of the stencil material or in a parameter representing the information.

Further, in order "to obtain the kind of the stencil material", the kind may be obtained either by the operator of the system directly inputting the kind through a predetermined input means or by storing kind data, for instance, in a memory provided in the stencil material roll and reading out the same.

Further, the expression "to control the heating energy to the thermal head according to the kind of the stencil material and the residue" means to control, for instance, the heating energy to increase as the modulus of the stencil material lowers, since contact of the stencil material to thermal head deteriorates as the modulus of the stencil material lowers when the residue is the same.

Further, in order "to obtain the elapsed time", the elapsed time may be obtained either by the operator of the system directly inputting the elapsed time through a predetermined input means or by providing, for instance, a clock and subtracting the date data representing the date of production of the stencil material roll from the date data representing the present. Further, the date data representing the date of production of the stencil material roll may be directly input by the operator through a predetermined input means, or may be read out from a memory which is provided on the stencil material roll and in which the date data representing the date of production of the stencil material roll is stored.

Further, the expression "to control the heating energy to the thermal head according to the elapsed time" means to control the heating energy to increase as the elapsed time increases, since the surface smoothness of the stencil material deteriorates and contact of the stencil material to the thermal head deteriorates as the elapsed time increases.

Further, the expression "to control the heating energy to the thermal head according to the working environmental temperature and the elapsed time" means to control, for instance, the heating energy to increase as the working environmental temperature lowers when the elapsed time is the same in the same manner as described above.

Further, the expression "to control the heating energy to the thermal head according to the kind and the elapsed time" means to control, for instance, the heating energy to increase as the modulus of the stencil material lowers when the elapsed time is the same in the same manner as described above.

The above-mentioned "storage means" includes, for instance, a memory but may includes those which stores data as a bar code, or other characters or symbols.

In the first thermal head control method and system of the present invention, the heating energy to the thermal head is controlled on the basis of the residue of the stencil material in the stencil material roll, that is, the heating energy to the thermal head is increased by the degree of deterioration of the surface smoothness of the stencil material due to reduction of the residue. Accordingly, the heating energy to the thermal head can be controlled according to the surface condition of the stencil material without adding to the overall size of the system or the cost of the system. Accordingly, deterioration of the quality of the printed image due to fluctuation in perforations can be avoided.

When the working environmental temperature is detected, and the heating energy to the thermal head is controlled on the basis of the working environmental temperature detected and the residue, heat given from the thermal head to the stencil material can be constant without affected by the working environmental temperature.

When the kind of the stencil material is obtained, and the heating energy to the thermal head is controlled on the basis of the obtained kind and the residue, the stencil making is stabilized without affected by difference in contact of the stencil material to the thermal head due to difference in the kind of the stencil material.

In the second thermal head control method and system of the present invention, the heating energy to the thermal head is controlled on the basis of the elapsed time from the production of the stencil material roll. Accordingly, when the surface smoothness of the stencil material deteriorates due to that the time has elapsed from the production of the stencil material roll, the heating energy to the thermal head can be controlled according to the surface condition of the stencil material without adding to the overall size of the system or the cost of the system. Accordingly, deterioration of the quality of the printed image due to fluctuation in perforations can be avoided.

When the working environmental temperature is detected, and the heating energy to the thermal head is controlled on the basis of the working environmental temperature detected and the elapsed time, heat given from the thermal head to the stencil material can be constant without affected by the working environmental temperature.

When the kind of the stencil material is obtained, and the heating energy to the thermal head is controlled on the basis of the obtained kind and the elapsed time, the stencil making is stabilized without affected by difference in contact of the stencil material to the thermal head due to difference in the kind of the stencil material.

In the first stencil material roll of the present invention which is provided with a storage means which stores residue data according to the residue of the stencil material, for instance, even when a partly used stencil material roll is installed, a residue of the stencil material in the partly used stencil material roll can be automatically obtained and a residue of the stencil material can be accurately calculated thereafter. Further, even if a stencil material roll whose total length is not known to the operator is installed, the total length of the stencil material roll can be automatically obtained.

In the second stencil material roll of the present invention, since the second stencil material roll of the present invention has a storage means which stores kind data according to the kind of the stencil material, the kind data of the stencil material can be automatically obtained by reading out the same from the storage means.

In the third stencil material roll of the present invention, since the third stencil material roll of the present invention has a storage means which stores date data on the date of production of the stencil material roll, the date data on the date of production of the stencil material roll can be automatically obtained by reading out the same from the storage means when the time which has elapsed from the production of the stencil material roll is to be obtained.

PREFERRED EMBODIMENTS OF THE INVENTION

Figure 1:
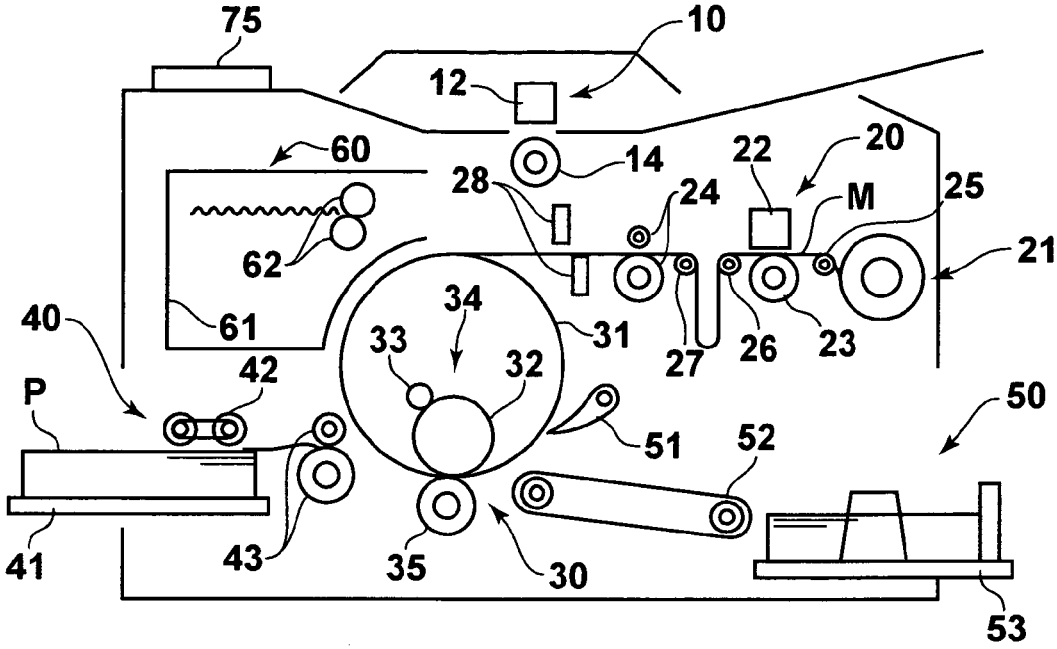
FIG. 1 is a view showing in brief a stencil printer employing a thermal head control system in accordance with an embodiment of the present invention.

A stencil printer employing a thermal head control system in accordance with an embodiment of the present invention will be described with reference to the drawings, hereinbelow. FIG. 1 is a view showing in brief the stencil printer.

As shown in FIG. 1, the stencil printer comprises a reading portion 10 which reads out an image on an original, a stencil making portion 20 which makes a stencil from stencil material on the basis of the image information read by the reading portion 10, a printing portion 30 which prints on a printing paper by the use of the stencil M made by the stencil making portion 20, a paper supply portion 40 which supplies the printing paper to the printing portion 30, a paper discharge portion 50 which discharges the printed printing paper from the printing portion 30, and a stencil discharge portion 60 which discharges the stencil M after use.

The image read-out portion 10 is an image scanner and comprises an image line sensor 12 which reads out an image on an original conveyed in a sub-scanning direction, and original feed rollers 14.

Figure 2:
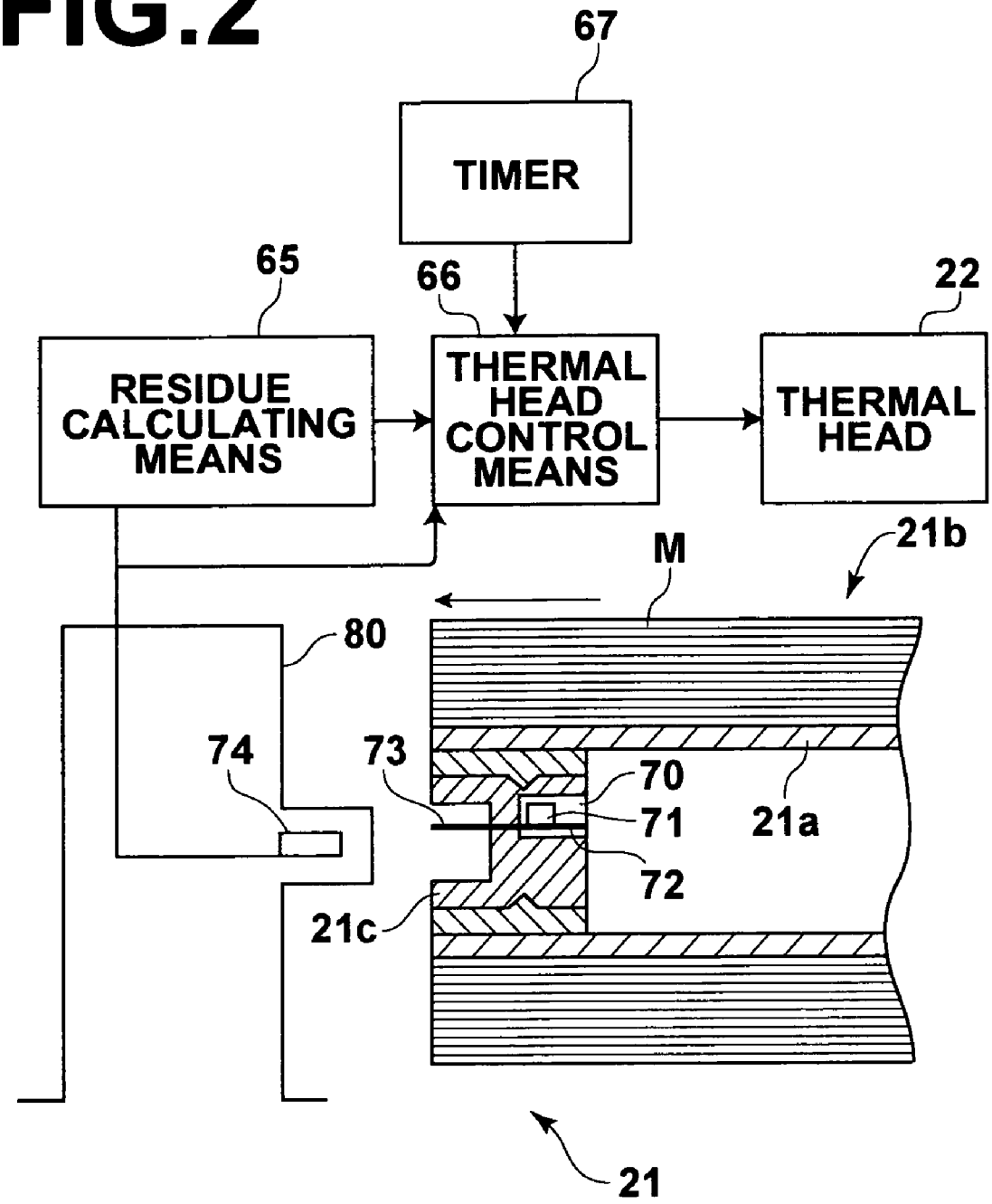
FIG. 2 is a block diagram of a part of the stencil printer shown in FIG. 1, FIGS. 3A and 3B are views showing stencil making energy changing tables which the thermal head control system shown in FIG. 2 is provided with, and FIG. 4 a block diagram of a part of a stencil printer employing a thermal head control system in accordance with another embodiment of the present invention.

The stencil making portion 20 comprises a stencil material roll portion 21, a stencil making unit 22 having a thermal head where plurality of heater elements are arranged in a row, stencil material feed rollers 23 and 24, stencil material guide rollers 25, 26 and 27, and a stencil cutter 28. As shown in FIG. 2, in the stencil material roll portion 21, a stencil material roll 21*b* comprising stencil material M wound around a paper core 21*a* is mounted on a master holder 80 to be changeable. A storage means 70 which stores length data on a total length of the stencil material roll 21*b* before use and the residue of the stencil material M after use of the stencil material roll 21*b* is disposed in a support member 21*c* mounted for rotation on one end portion of the paper core 21*a* of the stencil material roll 21*b*. In the storage means 70, the kind data of the stencil material M of the stencil material roll 21*b* and the date data on the date of production of the stencil material roll 21*b* have been further stored. The kind data of the stencil material M comprises, for instance, the modulus of the stencil material M. The storage means 70 comprises a memory IC 71 forming a non-volatile memory (e.g., an EEPROM) which can hold data for a predetermined time without power supply, and a contact 73 is provided on the tip of a board 72 on which the memory IC 71 is mounted. Further, as shown in FIG. 2, a connector 74 to be electrically connected to the contact 73 of the first storage means 70 of the stencil material roll 21*b* is disposed in the master holder 80. The connector 74 functions as a part of a residue calculating means 65 to be described later.

The printing portion 30 comprises a cylindrical ink-transmittable printing drum 31 which is formed of a porous metal plate or a mesh structure, an ink supply system 34 having a squeegee roller 32, and a doctor roller 33 which are disposed inside the printing drum 31, and a press roller 35. The stencil is wound around outer periphery of the printing drum 31.

The paper supply portion 40 comprises a paper supply table 41 on which printing papers P are stacked, a pick-up roller 42 which takes out the printing papers P one by one from the paper supply table 41, and a pair of timing rollers 43 which send a printing paper P between the printing drum 31 and the press roller 35.

The stencil discharge portion 60 comprises a stencil discharge box 61 which is disposed on one side of the printing portion 30 and in which the stencil peeled off the printing drum 31 is placed, and a pair of stencil discharge rollers 62 which peel the stencil off the printing drum 31 after use and convey the stencil peeled off the printing drum 31 into the stencil discharge box 61.

Further, as shown in FIG. 2, the stencil printer of this embodiment is provided with the residue calculating means 65 which calculates the residue of the stencil material roll 21*b* by cumulatively subtracting the length of the stencil from the total length of the stencil material roll 21*b* before use each time a stencil is made and a thermal head control means 66 which controls the heating energy to the thermal head 22 on the basis of the stencil material roll residue calculated by the residue calculating means 65.

In the thermal head control means 66, a pair of stencil making energy changing tables shown in FIGS. 3A and 3B are stored. According to the stencil making energy changing table, the heating energy to the thermal head 22 can be obtained on the basis of the residue of the stencil material M in the stencil material roll 21*b* and the elapsed time from production of the stencil material roll 21*b* as can be understood from FIGS. 3A or 3B. In the stencil making energy changing table, "standard" means predetermined standard heating energy, and, for instance, "+2.5%" means heating energy larger than the "standard" by 2.5%. The thermal head control means 66 has a pair of stencil making energy changing tables shown in FIGS. 3A and 3B, and selects the stencil making energy changing table shown in FIG. 3A or that shown in FIG. 3B on the basis of the kind data of the stencil material M stored in the storage means 70 of the stencil material roll 21*b*. In this particular embodiment, the kind data of the stencil material M represents the modulus of the stencil material M. When the modulus of the stencil material M is larger than a predetermined threshold value, the stencil making energy changing table shown in FIG. 3A is selected, whereas when the modulus of the stencil material M is not larger than the predetermined threshold value, the stencil making energy changing table shown in FIG. 3B is selected. That is, since as the modulus of the stencil material M is larger, contact of the stencil material M to the thermal head 22 becomes closer, the tables shown in FIGS. 3A and 3B are set so that the heating energy is smaller as the modulus of the stencil material M is larger. Further, since the surface smoothness of the stencil material M more deteriorates as the elapsed time from production of the stencil material roll becomes longer, the tables shown in FIGS. 3A and 3B are set so that the heating energy is larger as the elapsed time is longer.

Though, in this embodiment, the stencil making energy changing tables shown in FIGS. 3A and 3B are stored in the thermal head control system 66 of the stencil printer, the stencil making energy changing tables shown in FIGS. 3A and 3B may be stored in the storage means 70 of the stencil material roll 21*b* while the thermal head control system 66 selects the stencil making energy changing table shown in FIG. 3A or that shown in FIG. 3B which are stored in the storage means 70 on the basis of the kind data of the stencil material M read out from the storage means 70 and reads out the selected stencil making energy changing table from the storage means 70.

Operation of the stencil printer of this embodiment will be described, hereinbelow.

A stencil material roll 21*b* is first installed on the master holder 80 and the stencil material M is unrolled from the stencil material roll 21*b* in a length corresponding to one stencil. Then the stencil material M is perforated into a stencil by the thermal head 22 whose heater elements are selectively heated in the stencil making portion 20. The heating energy the thermal head 22 is obtained in the manner to be described later and the temperature of the thermal head 22 is controlled.

In response to installment of the stencil material roll 21*b* on the master holder 80, the connector 74 on the master holder 80 is electrically connected to the contact 73 of the storage means 70 provided on the stencil material roll 21*b*, whereby the total length of the stencil material roll 21*b* before use which is stored in the first storage means 71 is read out by the residue calculating means 65 and is stored in a memory 66 provided in the residue calculating means 65. Data on a length corresponding to one stencil has been stored in the memory 66, and the residue calculating means 65 calculates the number of stencils which the stencil printer can further make by dividing the total length of the stencil material roll 21*b* by the length corresponding to one stencil and outputs the number to the thermal head control means 66. Further, the kind data of the stencil material M and the date data on the date of production stored in the storage means 70 of the stencil material roll 21*b* are also output to the thermal head control means 66. The thermal head control means 66 selects the stencil making energy changing table shown in FIG. 3A or that shown in FIG. 3B on the basis of the kind data of the stencil material M and calculates the elapsed time from production of the stencil material roll 21*b* on the basis of the date data on the date of production. In this particular embodiment, a timer 67 which indicates the current time is provided in the stencil printer, and the thermal head control means 66 calculates the elapsed time by subtracting the date data representing the date of production of the stencil material roll from the date data representing the present readout from the timer 67. The thermal head control means 66 obtains the heating energy to the thermal head 22 on the basis of the number of the stencils input thereinto in the manner described above, and the elapsed time calculated in the manner described above referring to the stencil making energy changing table selected according to the kind data of the stencil material M, and controls the voltage applied to the thermal head 22 on the basis of the obtained heating energy to the thermal head 22, thereby controlling the heating action of each heater elements of the thermal head 22.

The stencil made by the thermal head 22 whose heating action is controlled in the manner described above is cut by the stencil cutter 28 and is wound around the printing drum 31.

Ink in a predetermined color is supplied inside the printing drum 31 by the ink supply system 34. As the printing drum is rotated in the counterclockwise direction as seen in FIG. 1, a printing paper P is moved left to right as seen in FIG. 1 by the timing rollers 43 to be supplied between the printing drum 31 and the press roller 35 at a predetermined timing in synchronization with the rotation of the printing drum 31. The printing paper P is subsequently pressed by the press roller 35 against the stencil on the outer peripheral surface of the printing drum 31, whereby the printing paper P is printed with the ink in the predetermined color.

Together with the stencil making action and the printing action described above, the length of the stencil which has been stored in the memory 66 is subtracted from the total length of the stencil material roll 21*b* before use which has been stored in the memory 66 in the residue calculating means 65 and the value obtained is stored again in the memory 66 as the residue of the stencil material roll 21*b*. The residue of the stencil material roll 21*b* stored in the memory 66 is stored in the storage means 70 by way of the connector 74 and the contact 73. When the stencil making action is to be performed next, the residue calculating means 65 reads out the residue of the stencil material roll 21*b* which has been stored in the storage means 70 to calculate the number of stencils which can be further made in the same manner as described above, and output the number to the thermal head control means 66. The thermal head control means 66 obtains the heating energy to the thermal head 22 on the basis of the number of the stencils input thereinto in the manner described above, and the elapsed time calculated in the manner described above referring to the stencil making energy changing table and controls the temperature of the thermal head 22 on the basis of the obtained heating energy to the thermal head 22 during the next stencil making.

By repeating the action described above, the temperature of the thermal head 22 is controlled with heating energy according to the residue of the stencil material M in the stencil material roll 21*b* and the elapsed time from production of the stencil material roll 21*b*.

In the above-mentioned stencil printer, since the residue of the stencil material M in the stencil material roll 21*b* is calculated and the heating energy to the thermal head 22 is controlled on the basis of the calculated residue, that is, the heating energy to the thermal head 22 is controlled to be larger by the amount corresponding to deterioration of the surface smoothness of the stencil material due to reduction in the residue, the heating energy to the thermal head can be controlled according to the surface condition of the stencil material without adding to the overall size of the system or the cost of the system. Accordingly, deterioration of the quality of the printed image due to fluctuation in perforations can be avoided.

Further, since the elapsed time from production of the stencil material roll is obtained and the heating energy to the thermal head is controlled on the basis of the obtained elapsed time, the heating energy to the thermal head can be controlled according to the surface condition of the stencil material also for the deterioration of the surface smoothness of the stencil material due to elapse of the time from production of the stencil material roll.

Further, since the kind of the stencil material is obtained and the stencil making energy changing table is selected on the basis of the obtained kind, the stencil making is stabilized without affected by difference in contact of the stencil material to the thermal head due to difference in the kind of the stencil material.

Figure 4:
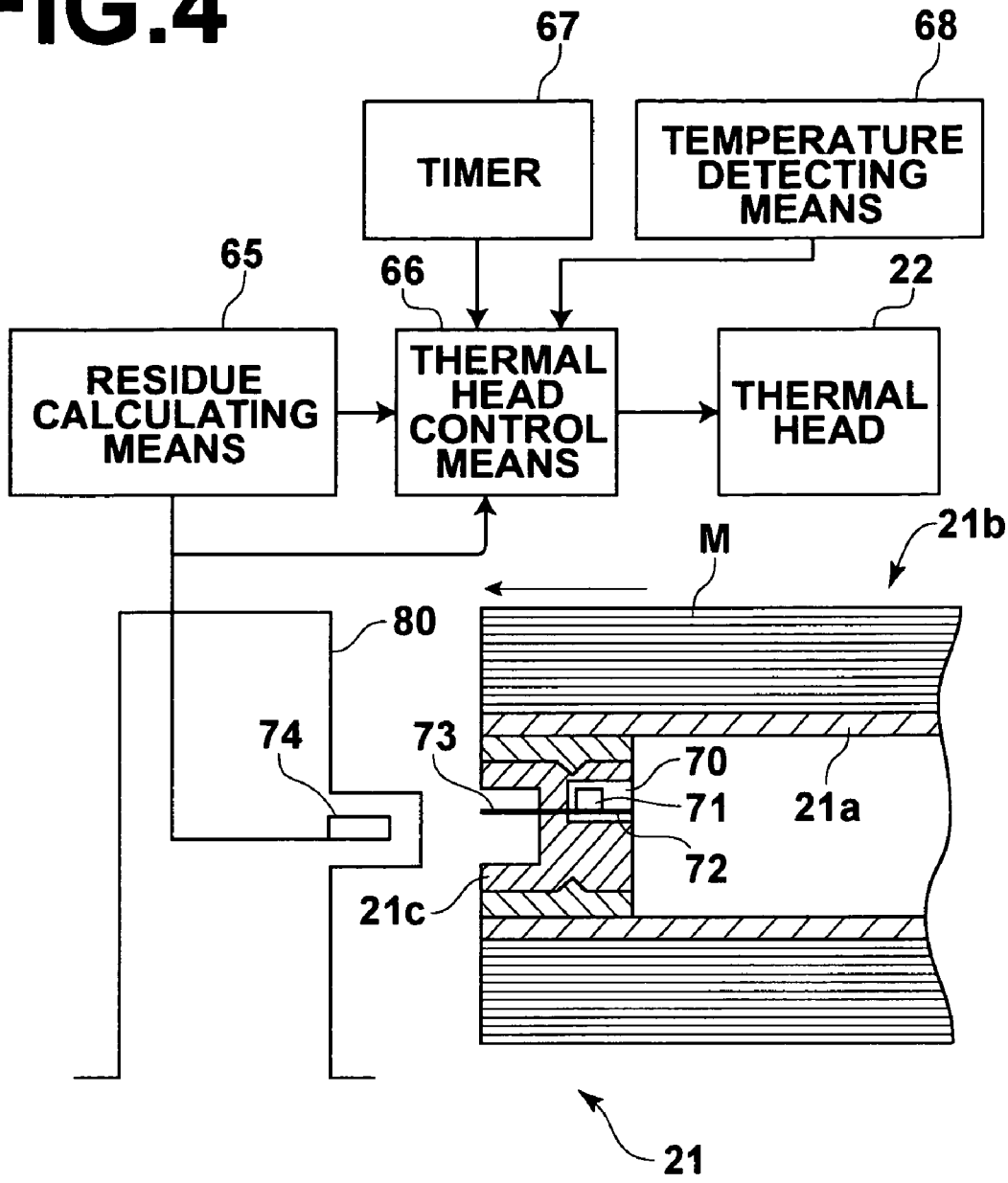

It is possible to add a temperature detecting means 68 to the embodiment described above as shown in FIG. 4 so that the working environmental temperature of the thermal head is measured, the stencil making energy changing table according to the working environmental temperature is stored in the thermal head control system, and the heating energy to the thermal head is obtained on the basis of the kind, the residue, the elapsed time from production and the working environmental temperature of the stencil material in the stencil material roll 21*b*. In this case, the stencil making energy changing table may be made so that the heating energy to the thermal head is larger than as the working environmental temperature lowers under the condition where the kind, the residue, and the elapsed time from production of the stencil material are the same.

The heating energy to the thermal head need not be obtained on the basis of all of the kind, the residue, the elapsed time from production and the working environmental temperature of the stencil material in the stencil material roll 21*b*, other any conditions may be added so long as the residue or the elapsed time is included in the conditions.

The invention claimed is:

1. A thermal head control system for controlling heating energy to a thermal head perforating stencil material unrolled from a stencil material roll comprising:

a residue obtaining means for obtaining an amount of stencil material remaining in the stencil material roll; and a thermal head controlling means for controlling the heating energy to the thermal head on the basis of the amount of remaining stencil material obtained by the residue obtaining means, such that the heating energy of the thermal head increases as the amount of remaining stencil material decreases.

2. The thermal head control system as defined in claim 1 further comprising:

a temperature detecting means for detecting the working environmental temperature of the thermal head, wherein the thermal head controlling means controls the heating energy to the thermal head on the basis of the working environmental temperature of the thermal head detected by the temperature detecting means and the amount of remaining stencil material.

3. The thermal head control system as defined in claim 1 further comprising:

a kind obtaining means for obtaining the kind of the stencil material, wherein the thermal head controlling means controls the heating energy to the thermal head on the basis of the kind of the stencil material obtained by the kind obtaining means and the amount of remaining stencil material.

4. The thermal head control system as defined in claim 3 wherein the stencil material roll is provided with a storage means for storing kind data according to the kind of the stencil material and the kind obtaining means reads the kind data from the storage means.

5. The thermal head control system of claim 1 further comprising:

an elapsed time obtaining means for obtaining elapsed time from the production of the stencil material roll, wherein the thermal head controlling means controls the heating energy to the thermal head on the basis of the elapsed time from the production of the stencil material roll obtained by the elapsed time obtaining means and the amount of remaining stencil material.

6. The thermal head control system as defined in claim 1 wherein the stencil material roll is provided with a storage means which for storing residue data according to the residue of the stencil material and the residue obtaining means obtains the residue of the stencil material on the basis of the residue data read from the storage means.

* * * * *